United States Patent [19]

Sullivan et al.

[11] Patent Number: 4,637,063

[45] Date of Patent: Jan. 13, 1987

[54] RECLOSABLE BAG WITH SEALED LAMINATED LINER AND METHOD

[75] Inventors: Brian P. Sullivan, Shelbyville; Larry T. Dennis, Greenwood; Robert A. Ferrell, Shelbyville, all of Ind.

[73] Assignee: KCL Corporation, Shelbyville, Ind.

[21] Appl. No.: 707,594

[22] Filed: Mar. 4, 1985

[51] Int. Cl.[4] ..... B65D 33/16

[52] U.S. Cl. ..... 383/61; 383/81; 383/111; 383/113; 493/189; 493/214; 493/217

[58] Field of Search ..... 383/61, 81, 111, 113; 493/189, 214, 217

[56] References Cited

U.S. PATENT DOCUMENTS

| | | | |
|---|---|---|---|
| 2,107,216 | 2/1938 | Rogers | 383/113 |
| 3,325,082 | 6/1967 | Naylor | 383/113 |
| 3,479,802 | 11/1969 | Fesco | 493/217 |
| 3,567,111 | 3/1971 | Baxter et al. | 383/113 |
| 3,827,472 | 8/1974 | Uramoto | 150/3 |
| 3,958,749 | 5/1976 | Goodrich | 383/111 |
| 4,088,264 | 5/1978 | Vogt | 383/111 |
| 4,241,865 | 12/1980 | Ferrell | 383/81 |
| 4,337,889 | 7/1982 | Moertel | 383/81 |

*Primary Examiner*—Stephen P. Garbe

*Attorney, Agent, or Firm*—Hill, Van Santen, Steadman & Simpson

[57] ABSTRACT

A bag structure and method of making the same, wherein a liner on the inside of the bag body has a closed top within the bag body top providing a primary closure for the bag which must be opened for access to contents within the bag. A secondary closure comprises a reclosable fastener zipper carried by the bag body top above the primary closure for access to the primary closure, and then serving for selectively opening and closing the bag top opening.

26 Claims, 11 Drawing Figures

RECLOSABLE BAG WITH SEALED LAMINATED LINER AND METHOD

This invention relates to the art of reclosable sacks or bags, and is more particularly concerned with a new and improved reclosable bag having a primary closure and a secondary closure, the latter being adapted for selectively opening and closing the top opening of the bag.

Relevant to this art is my U.S. Pat. No. 4,241,865 which provides a reclosable shipping sack or bag having a primary non reclosable stitched separable closure fastener across and closing the mouth of the bag against unintentional discharge of the contents and comprising a rip tape across the outside of the upper end of the bag and which is releasable by removing the stitching which secures the tape to the top of the bag. A zipper closure secured to the top of the bag serves as a secondary closure for closing the bag top after the primary closure has been opened.

Because the primary closure involves stitching, and the sacks or bags for which this type of closure has been primarily devised are generally of paper, and more frequently of multilayers of paper for heavy duty use, there is some paper fiber release during the stitching, and then further fiber release when the stitching is ripped out for opening the bag. For some kinds of contents which may be packaged in this type of heavy duty bag, paper fiber contamination is unacceptable. For example, certain discrete, granular or powdered chemical products must be maintained free from paper fiber contamination.

Generally, such materials may also require protection against deteriorating moisture, and the bags regardless of the material of the bag bodies, and in particular paper bags must be lined with a moisture barrier such as a heat sealable polymer. Bags of this type are known, and merely by way of a representative example U.S. Pat. No. 3,827,472 is referred to, although it discloses layers of plastic material, the inner of which provides a moisture barrier. In this patented construction a primary closure is provided by the unbroken bag top which comprises an integral part of the wall panels of the bag. The primary closure must be ripped off before access can be had to a secondary or rib and groove extruded zipper closure which is an integral extruded part of the liner and which will serve as a reclosable fastener after the primary closure has been ripped off. This arrangement is not suitable for heavy duty bags intended for commercial packaging.

An important object of the present invention is to overcome the disadvantages, drawbacks, and efficiencies, limitations, shortcomings and problems inherent in prior bag constructions wherein a dual closure arrangement is desirable, and which must be free from fiber contamination of packaged product contained within the bag.

Another object of the invention is to provide a bag structure and a method of making the same and wherein the bag is provided with a primary closure inside the bag top, and a secondary reclosable closure on the outside of the bag top.

In accordance with the principles of the present invention, there is provided a new and improved bag structure which comprises a bag body having a top with an opening for access into the bag, a liner on the inside of the bag body and having a closed top within the bag body top providing a primary closure for the bag and which must be opened for access to contents within the bag, and a secondary closure comprises reclosable fastener means carried by the bag body top above the primary closure for selectively opening and closing the top opening.

A new and improved method of making the bag is also provided.

Other objects, features and advantages of the invention will be readily apparent from the following description of a representative embodiment thereof, taken in conjunction with the accompanying drawings, although variations and modifications may be effected without departing from the spirit and scope of the novel concepts embodied in the disclosure and in which.

Figure 10:
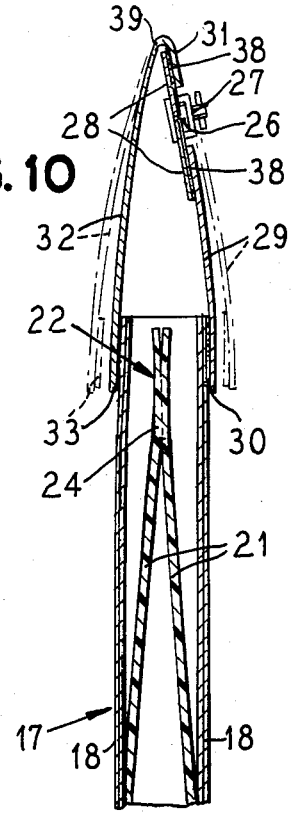

FIG. 10 demonstrates the joining of the zipper structure to the bag; and

Figure 11:
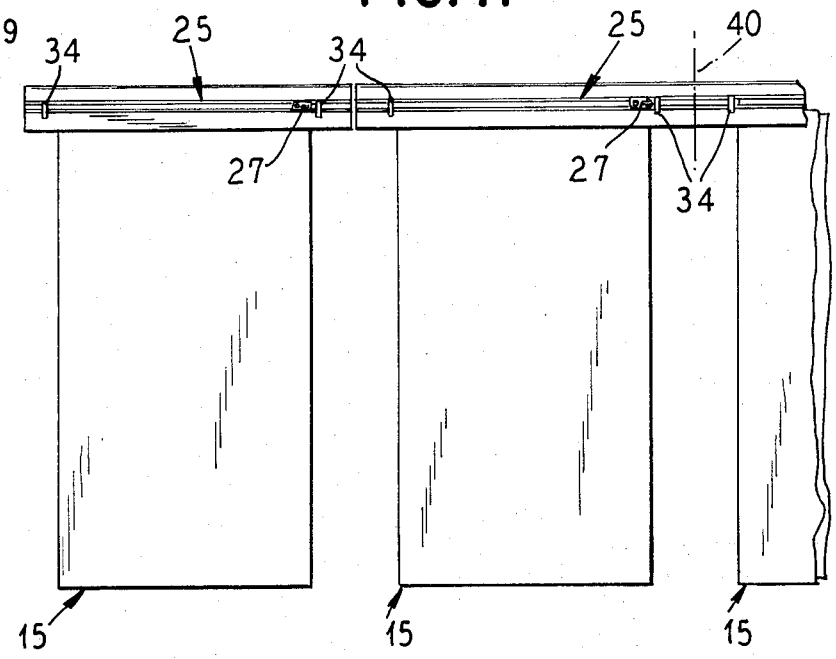

FIG. 11 is a fragmentary elevational view demonstrating a final stage in the making of the bags.

A bag structure 15, as shown in FIG. 1–5, comprises a generally tubular bag body 17 having opposite coextensive wall panels 18 which face one another in the flattened condition of the bag. Along their sides the panels 18 may be connected by means of gussets 19, although the invention is applicable also to bags without gussets. As manufactured, the bag 15 is preferably left open at its lower end through which the bag may be filled and expanded from the flattened storage and shipping condition, and the lower end then closed in any preferred manner as by sealing means 20 which may comprise turning the lower terminal end portion on itself and sewing or gluing it, or otherwise sealing it in the closed condition. For heavy duty commercial use, the bag body 17 is desirably made from a plurality of plys of tough craft paper, which may be as many as four plys, although for illustrative purposes only two plys are shown.

For some types of products to be bagged, the innermost ply of the bag body may serve as a liner, but for other types of product a synthetic plastic liner 21, which may also be a moisture and/or gas barrier, must be provided and which desirably comprises at least in part a heat sealable polymer.

In a preferred construction, the liner 21 comprises a heat sealable one side only material, and is a tubular structure complementary to the inside of the bag body 17. The liner 21 extends substantially throughout the length and width of the bag contiguous to the wall panels 18 and the inner surfaces of the gussets 19. In other words, the inside of the bag is completely lined by the liner 21 which thereby provides a complete barrier between the inner paper ply of the bag body and any product contents within the bag.

Desirably the liner material comprises a polyethylene coated polyester sheet or film which may comprise a 50 gauge (about half mil) film of polyester (such as Mylar or similar commercially available film) and an extrusion coating of about one mil of polyethylene. The polyethylene coating is on the inner surface of the liner 21.

According to the present invention, the upper or top end of the liner 21 provides a closed top primary bag closure 22 within the bag body top which has an opening 23 for access into the bag. Conveniently, the primary bag closure 22 comprises the upper end of the liner 21 collapsed upon itself and the polyethylene surface heat sealed to provide a thorough hermetic seal 24 across the entire width of the liner including its gusset sides. It will be understood that by virtue of its complete tubular complement of the liner 21 to the inner ply of the bag body 17, the heat seal 24 not only seals the collapsed upper free margins of the liner 21 extending between the gussets 19, but also those portions of the liner margins folded within the gussets 19, thereby providing a thoroughly sealed liner. To gain access to the contents within the bag, the primary closure 22 must be opened, as by ripping or cutting it which may be effected by some sort of cutting or trimming tool or by manual ripping force applied thereto. This can be effected without paper fiber contamination of bag contents.

In order to avoid any tearing loose of fibers from the contiguous paper layer of the bag during manipulations of the liner 21, the liner is maintained free from the paper throughout at least its upper primary closure portion. For maximum assurance against fiber contamination, only the lower end portion of the liner 21 may be spot sealed to the inside paper layer of the bag body as by means of adhesive spots 21*a* (FIG. 6) (such as a starch/dextrine glue) similarly as the layers of the bag body may be tacked in order to avoid displacement during bottom end filling of the bag.

Figure 2:
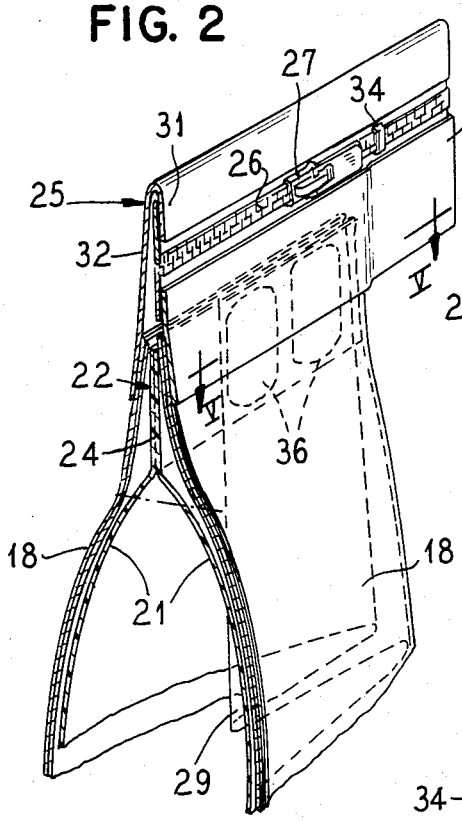
FIG. 2 is a sectional perspective view taken substantially along the line II—II in FIG. 1.
Figure 1:
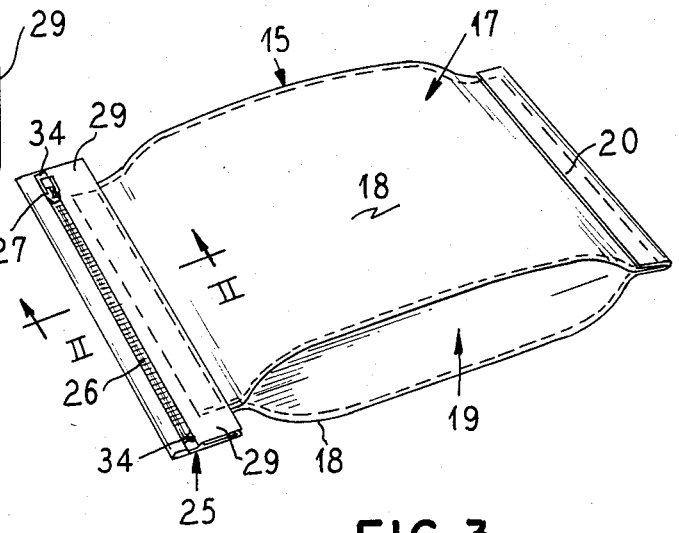
FIG. 1 is a perspective view of a bag embodying the invention.
Figure 3:
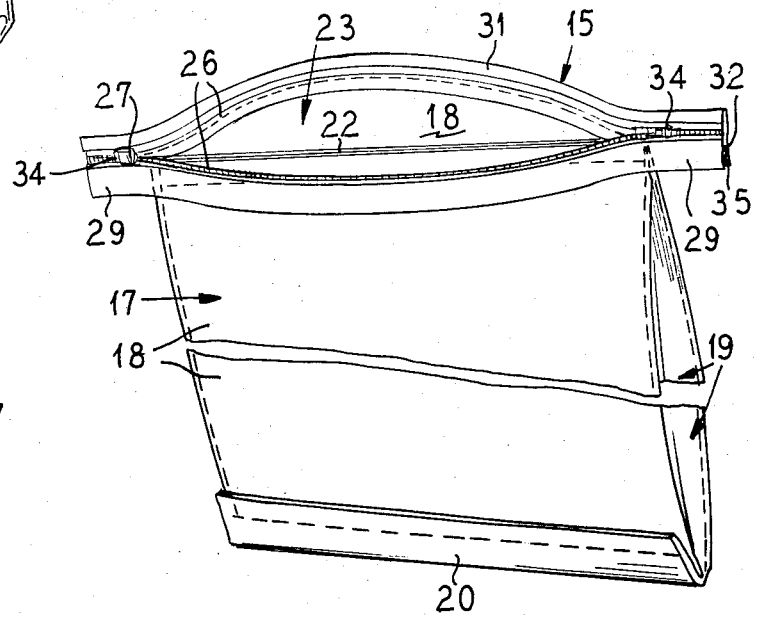
FIG. 3 is a fragmental perspective view of the bag with the secondary closure open.
Figure 4:
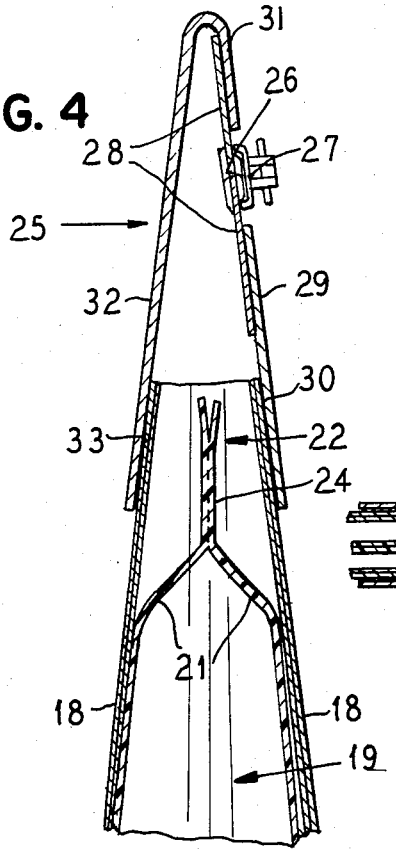
FIG. 4 is a sectional elevational view looking toward the right in FIG. 2.
Figure 5:
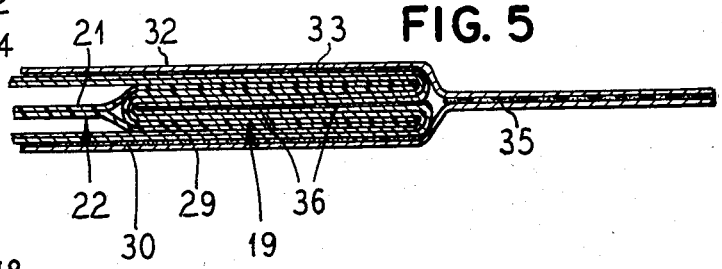
FIG. 5 is an enlarged fragmentary sectional detail view taken substantially along the line V—V in FIG. 2.

Since it may sometimes be desired to discharge only a part of the contents of the bag 15, and then to close the bag against spilling or undesirable intrusion of contaminants, or even just to provide a protective strong, easily accessible and openable top closure for the bag, a secondard closure 25 for the bag top is desirably provided. In a preferred construction, the top closure 25 comprises a zipper 26 having a slider 27 for manipulating the same and equipped with stringers 28. One of the stringers 28 is adhesively attached to an attachment flange 29 which in turn is attached as by means of adhesive 30 to the top end of one of the bag panels 18. The other stringers 28 is attached as by means of adhesive to a return bent flange 31 of an attachment flange 32 of the closure 25 and which is attached as by means of adhesive 33 to the top end portion of the other of the wall panels 18 of the bag body. In a preferred arrangement, opposite end portions of the top closure 25 extend beyond the sides of the bag; and stops 34 are secured across those end portions of the zipper 25 to limit travel of the slider 27 between the closed zipper position at one side of the bag as shown in FIGS. 1 and 2 and the open zipper position shown in FIG. 3 where the zipper is at the other side of the bag. Those portions of the attachment flanges 29 and 32 which project beyond the opposite sides of the bag are sealed together as by means of adhesive 35 (FIG. 5). Adhesive 36 preferably secures the infolded layers of the upper end portions of the gussets 19, and together with the sealed end portions of the zipper flanges avoids spillage in that area when pouring discrete material from the bag.

From the foregoing it will be apparent that the bag 15 is provided with a primary closure inside the top of the bag and a secondary closure on the outside of the top of the bag. In this instance the primary closure is nonreclosable once it has been opened. On the other hand, the secondary closure is a reclosable closure.

Figure 6:
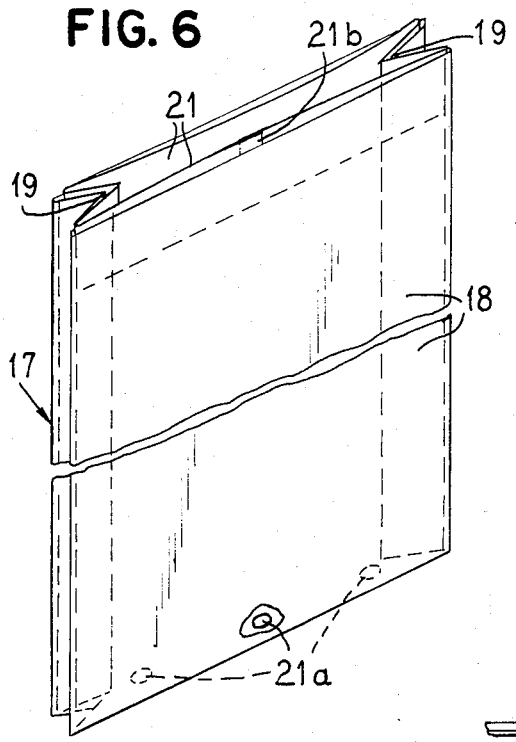
FIG. 6 is a perspective view demonstrating a stage in the method of making the bag.

FIGS. 6–11 exemplify various steps in a preferred method of making the bag structure of the present invention. Thus, as shown in FIG. 6, the bag body 17 is formed as a collapsed tube having the liner 21 minimally fixed therein. Details of arriving at the collapsed tubular form are not presented because that is well known technique. Suffice it to say that the various layers of paper for the bag body, and the liner 21, are fed to a so-called tuber wherein continuous strips of the material are superposed, tubularly formed and secured together at the meeting longitudinal edges. Since the liner has an inner heat sealable layer it is simple to secure the longitudinal edges of the liner by means of a continuous heat sealed joint 21*b*. The continuous tube is then collapsed upon itself with the gussets 19 formed at the opposite sides of the collapsed tube, and the tube is cut off into the desired bag lengths to provide individual bag bodies 17.

Figure 7:
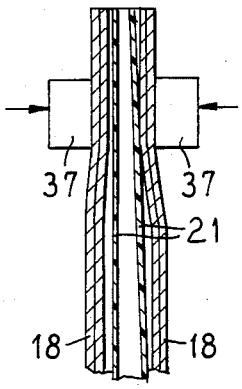
FIG. 7 is a fragmentary vertical sectional detail view taken substantially along the line VII—VII in FIG. 6, demonstrating a further step in making the bag.
Figure 8:
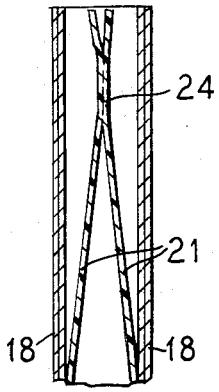
FIG. 8 is a view similar to FIG. 7 but showing the bag after the primary closure has been formed.

Either while the collapsed tube is in a continuous strip, or as a separate operation after separation into bag lengths, the primary closure seals 24 may be formed across the top end portion of the liner 21 for each bag length as by means of heated bar sealing means 37 (FIG. 7). Since the low density polyethylene inside layer of the liner 21 has a fusion point substantially less than the char point of the paper sack or bag material of the bag body 17, heat from the bars 37 pressing toward one another and thus compressing the area of the bag top engaged thereby and squeezing the opposite wall portions of the liner top together while applying the fusion heat, quickly attains the desired result. Thereafter, when the top opening portions of the bag side walls 18 are spread apart as shown in FIG. 8, the top end seal closure 24 causes the upper end portion of the liner 21 to assume a generally tent like closure effect. This relative freedom of the liner closure top will facilitate access to this closure 24, for opening the same when access to the bag contents is subsequently desired.

Figure 9:
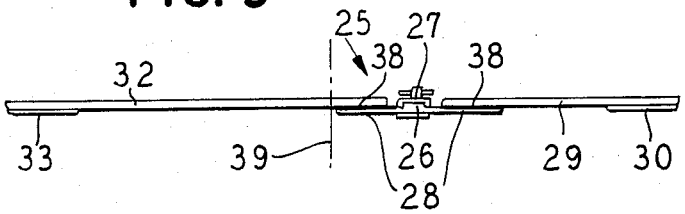
FIG. 9 is an end elevational view of zipper structure for providing a secondary closure for the bag.

Application of the secondary closure 25 to the bag tops may be effected substantially as disclosed in the before-mentioned U.S. Pat. No. 4,241,865, with the exception that instead of the zipper stringers 28 being stitched onto the attachment flanges 29 and 32, the attachment means comprises adhesive 38. As shown in FIG. 9, the zipper closure 25 may be prefabricated in a flat condition, and with even the attachment adhesive 33 in the form of a reactivatible adhesive applied before the zipper assembly is joined to the top end of the bag body 17 by folding the preferably continuous ribbon-like assembly upon itself about a longitudinal fold line 39 and applying and attaching the adhesive carrying end portions of the attachment flanges 29 and 32 to the outside faces of the top end portions of the bag wall panels 18 substantially as indicated in FIG. 10. Such attachment of the secondary closure 25 to a spaced succession of the bags 15 may be effected in a continuous production line mode to provide a chain of bags, as indicated in FIG. 11. After the continuous ribbon of the secondary closure zipper 25 has been attached, the zipper is severed along a respective line 40 intermediate each adjacent pair of the spaced successive bags to separate each bag 15 from the chain. If preferred, of course, the zipper closure 25 may be applied in substantially the manner disclosed in U.S. Pat. No. 4,241,865, wherein the several components of the zipper closure are brought together along the production line and secured together and to the bag units.

After the bags 15 have been completed, but with their bottom ends open for filling, the bags may be stacked and packed for shipment to a bag filling installation, or they may be taken directly to a bag filling line and filled and the open bottom ends then closed.

It will be understood that variations and modifications may be effected without departing from the spirit and scope of the novel concepts of the present invention.

We claim as our invention:

1. A bag structure, comprising:

a bag body having a top with an opening for access into the bag;

a liner on the inside of said bag body and having a closed top within the bag body top providing a primary closure for the bag and which must be opened for access to contents within the bag;

a secondary closure comprising reclosable fastener means carried by said bag body top above said primary closure for selectively opening and closing said top opening; and said bag body comprising a plurality of paper plys and said liner comprising a plastic film complementary to an inner ply of the bag body and attached to said inner ply at a bottom end of said bag body, and free from said inner ply at said bag top.

2. A bag structure according to claim 1, wherein said bag body has gussets at the opposite sides, and said liner and inner ply form parts of said gussets.

3. A bag structure according to claim 1, wherein said liner comprises a plastic material which on at least its inner surface is heat sealable, and said closed top of the liner comprises a heat fusion seal which extends along the entire top of the liner.

4. A bag structure according to claim 1, wherein said liner comprises an inner thermoplastic layer on a nonfusible substrate, and said top is closed by a heat seal of said inner layer across the top of the liner.

5. A bag structure according to claim 4, wherein said heat seal comprises a heat seal band along and spaced from the extremity of the top end portion of the liner.

6. A bag structure according to claim 1, wherein said closed liner top provides a tent-like closure which is accessible for opening thereof when the secondary reclosable fastener means closure is opened.

7. A bag structure according to claim 1, wherein said liner comprises a low density polyethylene layer on the inner side of a polyester film.

8. A bag structure according to claim 1, wherein said secondary closure comprises a zipper straddling the bag top over said opening, said bag body having wall panels, and said zipper having attachment flanges secured to the upper end portions of said wall panels.

9. A bag structure according to claim 8, wherein said attachment flanges extend beyond opposite sides of the bag body, and means securing the extending portions of the attachment flanges to one another.

10. A bag structure according to claim 9, wherein said bag body has gussets along the opposite sides, said gussets extending at their upper ends between said attachment flanges, said liner at its sides having gusset portions extending into said bag body gussets including said upper ends, and said upper ends of the bag body gussets and the gusset portions of the liner therein being sealed against spillage therethrough of pourable bag contents.

11. A bag structure, comprising:

a bag body having a top with an opening for access into the bag;

a liner on the inside of said bag body and having a closed top within the bag body top providing a primary closure for the bag and which must be opened for access to contents within the body;

a secondary closure comprising reclosable fastener means carried by said bag body top above said primary closure for selectively opening and closing said top opening;

said linear comprising a plastic material which on at least its inner surface is heat sealable; and said closed top of the liner comprising a heat fusion seal which extends along the entire top of the liner.

12. A bag structure, comprising:

a bag body having a top with an opening for access into the bag;

a liner on the inside of said bag body and having a closed top within the bag body top providing a primary closure for the bag and which must be opened for access to contents within the bag;

a secondary closure comprising reclosable fastener means carried by said bag body top above said primary closure for selectively opening and closing said top opening;

said liner comprising an inner thermoplastic layer on a nonfusible substrate; and said top being closed by a heat seal of said inner layer across the top of the liner.

13. A bag structure according to claim 12, wherein said heat seal comprises a heat seal band along and spaced from the extremity of the top end portion of the liner.

14. A bag structure, comprising:

a bag body having a top with an opening for access into the bag;

a liner on the inside of said bag body and having a closed top within the bag body top providing a primary closure for the bag and which must be opened for access to contents within the bag;

a secondary closure comprising reclosable fastener means carried by said bag body top above said primary closure for selectively opening and closing said top opening;

said secondary closure comprising a zipper straddling the bag top over said opening, said bag body having wall panels, and said zipper having attachment flanges secured to the upper end portions of said wall panels;

said attachment flanges extending beyond opposite sides of the body;

means securing the extending portions of the attachment flanges to one another;

said bag body having gussets along the opposite sides;

said gussets extending at their upper ends between said attachment flanges;

said liner at its sides having gusset portions extending into said bag body gussets including said upper ends; and said upper ends of the bag body gussets and the gusset portions of the liner therein being sealed against spillage therethrough of pourable bag contents.

15. A method of making a bag structure, comprising:

forming a bag body having a top with an opening for access into the bag;

providing a liner inside of said bag body and providing a closed top primary bag closure on the top of the liner within the bag body top and which must be opened for access to contents within the bag;

providing a secondary closure comprising a reclosable fastener means on said bag body top above said primary closure for selectively opening and closing said top opening;

forming said liner from a plastic material which on at least its inner surface is heat sealable;

providing said primary bag closure by heat sealing along the entire top of the liner.

16. A method of making bag structure, comprising:

forming a bag body having a top with an opening for access into the bag;

providing a liner inside of said bag body and providing a closed top primary bag closure on the top of the liner within the bag body top and which must be opened for access to contents within the bag;

providing a secondary closure comprising reclosable fastener means on said bag body top above said primary closure for selectively opening and closing said top opening;

forming said liner with an inner thermoplastic layer on a nonfusible substrate; and providing said closed top primary bag closure by heat sealing said inner layer across the top of the liner.

17. A method of making a bag structure, comprising:

forming a bag body having a top with an opening for access into the bag;

providing a liner inside of said bag body and providing a closed top primary bag closure on the top of the liner within the bag body top and which must be opened for access to contents within the bag;

providing a secondary closure comprising reclosable fastener means on said bag body top above said primary closure for selectively opening and closing said top opening;

supplying said secondary closure as a zipper straddling the bag top over said top opening;

securing attachment flanges to the upper end portions of side wall panels of said bag body;

extending said attachment flanges beyond opposite sides of the bag body; and securing the extending portions of the attachment flanges to one another;

forming said bag body with gussets along its opposite sides;

extending the gussets at their upper ends between said attachment flanges;

providing said liner with gusset portions extending into said gussets including said upper ends of said gussets; and sealing said upper ends of said gussets and said gusset portions against spillage therethrough of pourable bag contents.

18. A method of making a bag structure, comprising:

forming a bag body having a top with an opening for access into the bag;

providing a liner inside of said bag body and providing a closed top primary bag closure on the top of the liner within the bag body top and which must be opened for access to contents within the bag;

providing a secondary closure comprising reclosable fastener means on said bag body top above said primary closure for selectively opening and closing said top opening;

forming said bag body from paper;

forming said liner from material which is heat sealable on at least the inner face of said liner at a temperature lower than the char point of said paper; and forming said primary bag closure by applying heat sealing fusion temperature through the paper of the bag body to said top of the liner.

19. A method of making a bag structure, comprising:

forming a bag body having a top with an opening for access into the bag;

forming the bag body from a plurality of paper plys;

providing a liner inside of said bag body and providing a closed top primary bag closure on the top of the liner within the bag body top and which must be opened for access to contents within the bag;

forming said liner from a plastic film and complementary to an inner ply of the bag body;

attaching the liner to said ply of a bottom end of said bag body but leaving the liner free from the inner ply at said bag top;

and providing a secondary closure comprising reclosable fastener means on said bag body top above said primary closure for selectively opening and closing said top opening.

20. A method according to claim 19, which comprises forming gussets at the opposite sides of said bag body, and folding said liner into gussets within said body gussets.

21. A method according to claim 19, which comprises forming said liner from a plastic material which on at least its inner surfaces is heat sealable, and providing said primary bag closure by heat sealing along the entire top of the liner.

22. A method according to claim 19, which comprises forming said liner with an inner thermoplastic layer on a nonfusible substrate, and providing said closed top primary bag closure by heat sealing said inner layer across the top of the liner.

23. A method according to claim 19, which comprises forming said liner with a low density polyethylene layer on the inner side of a polyester film.

24. A method according to claim 19, which comprises supplying said secondary closured as a zipper straddling the bag top over said top opening, securing attachment flanges to the upper end portions of side wall panels of said bag body, extending said attachment flanges beyond opposite sides of the bag body, and securing the extending portions of the attachment flanges to one another.

25. A method according to claim 24, which comprises form said bag body with gussets along its opposite sides, extending the gussets at their upper ends between said attachment flanges, providing said liner with gusset portions extending into said gussets and including said upper ends of said gussets, and sealing said upper ends of said gussets and said gusset portions against spillage therethrough of pourable bag contents.

26. A method according to claim 19, which comprises forming said bag body from paper, forming said liner from material which is heat sealable on at least the inner face of said liner at a temperature lower than the char point of said paper, and forming said primary bag closure by applying heat sealing fusion temperature through the paper of the bag body to said top of the liner.

* * * * *